US006604615B2

(12) United States Patent
Wu

(10) Patent No.: US 6,604,615 B2
(45) Date of Patent: Aug. 12, 2003

(54) ROLLER DEVICE OF LUGGAGE CASE

(76) Inventor: Yi-Ming Wu, 3F, No. 85, Lane 6, Sec. 4, Cheng-De Rd., Taipei (TW)

( * ) Notice: Subject to any disclaimer, the term of this patent is extended or adjusted under 35 U.S.C. 154(b) by 104 days.

(21) Appl. No.: 09/986,163

(22) Filed: Nov. 7, 2001

(65) Prior Publication Data

US 2003/0085088 A1 May 8, 2003

(51) Int. Cl.[7] ..... A45C 5/14; B60B 33/06

(52) U.S. Cl. ..... 190/18 A; 280/37; 280/47.315; 16/34

(58) Field of Search ..... 190/18 A, 115; 280/47.315, 47.371, 37, 655, 47.17; 16/33, 34, 18 B, 29, 23

(56) References Cited

U.S. PATENT DOCUMENTS 2,002,836 A * 5/1935 Rossi ..... 190/18 A
3,917,038 A * 11/1975 Foge et al. ..... 190/18 A
4,254,850 A * 3/1981 Knowles ..... 190/18 A
4,273,222 A * 6/1981 Cassimally et al. ..... 190/18 A
4,845,804 A * 7/1989 Garrett ..... 16/34 X
5,533,231 A * 7/1996 Bai ..... 16/34
5,813,503 A * 9/1998 Chang ..... 180/18 A
6,289,554 B1 * 9/2001 Wang ..... 16/34
6,367,602 B1 * 4/2002 Chang ..... 190/18 A

* cited by examiner

*Primary Examiner*—Tri M. Mai
(74) *Attorney, Agent, or Firm*—Birch, Stewart, Kolasch & Birch, LLP

(57) ABSTRACT

A roller device of luggage case includes the luggage case having at least two retractile mechanisms with at least two rollers at each bottom side. The retractile mechanism is connected with retractable handle pivotally so that the rollers stick outside the bottom of the luggage case when the retractable handle is pulled up and completely hides within the luggage case while the retractable handle is folded up. Thus not only the luggage case has a better outlook but also the trouble of hooking with other luggage can be avoided.

1 Claim, 4 Drawing Sheets

ROLLER DEVICE OF LUGGAGE CASE

BACKGROUND OF THE INVENTION

1. Field of the Invention

The present invention relates to a roller device of luggage case, more particularly, to a luggage case having at least two retractile mechanisms with a roller device at each bottom side. The retractile mechanism is connected with retractable handle pivotally so that the rollers stick outside the bottom of the luggage case when the retractable handle is pulled up and completely hides within the luggage case by folding up the retractable handle. Therefore, the luggage cases have a better outlook and avoid dragging with other luggage when moving.

2. Description of the Prior Art

When people go abroad with heavy baggage such as clothes, toiletry bags, personal belongings, and lady's cosmetic that could not be packed into a conventional luggage bag or a suitcase, they are usually carrying a luggage case which can hold much more fitter.

After stuffing all those travel items in, the luggage case becomes clumsy and inconvenient for carrying by hands, especially to ladies. Someone comes the idea of attaching roller at the bottom of the luggage case and adding retractable handle at one side of the luggage case to improve the condition, so that users pull the handle and hold it to move the luggage case with its bottom roller.

However, as to the conventional luggage case, the roller firmly arranged at the bottom thereof outside the case possesses an odds concave shape and affects its outlook. Owing to the position at the bottom of the luggage case, the rollers is very easy to drag with the car seat when get on or off a car. When putting into the trunk of a tourist car, the roller may catch with other luggage and make moving the luggage a lot of trouble. All of these defectives are needed improvement.

SUMMARY OF THE INVENTION

It is therefore a primary object of the present invention to provide a roller device of luggage case, which possesses at least two retractile mechanisms with a roller therein at each bottom side respectively. The retractile mechanism is connected with a retractable handle pivotally. By pulling up the retractable handle, the roller protrudes outside the bottom of the luggage case. By folding up the retractable handle, the roller completely hides within the case bottom so as to have a better outlook. The problem of dragging with other luggage during moving is also avoided.

In order to achieve the object mentioned above, the present invention includes a retractable handle, at least two rollers arranged at the bottom side of the luggage case respectively. The invention is characterized in that the roller is mounted in the retractile mechanism that consists of a housing, a lateral covering plate and a bottom covering plate coaxial to the roller—both plate formed part of the lateral and bottom side of the luggage case, a roller support with the roller pivotally at one end and with a movable vertical stick at the other end, a swing plate hooked on the top of the movable vertical stick, a spring set between the swing panel and the housing. One end of the swing panel is pivoted on the wall of the luggage case while the other end is connected with the retractable handle. Accordingly, the roller on the bottom of the roller support extends to the outside of the bottom of the luggage case and the lateral covering plate as well as the bottom covering plate swing outward while pulled up the retractable handle. The designation of roller retracting into the bottom of luggage case by folding up the retractable handle is for good outlook and avoiding the trouble of hooking with other luggage.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DETAILED DESCRIPTION OF THE PREFERRED EMBODIMENT

Figure 1:
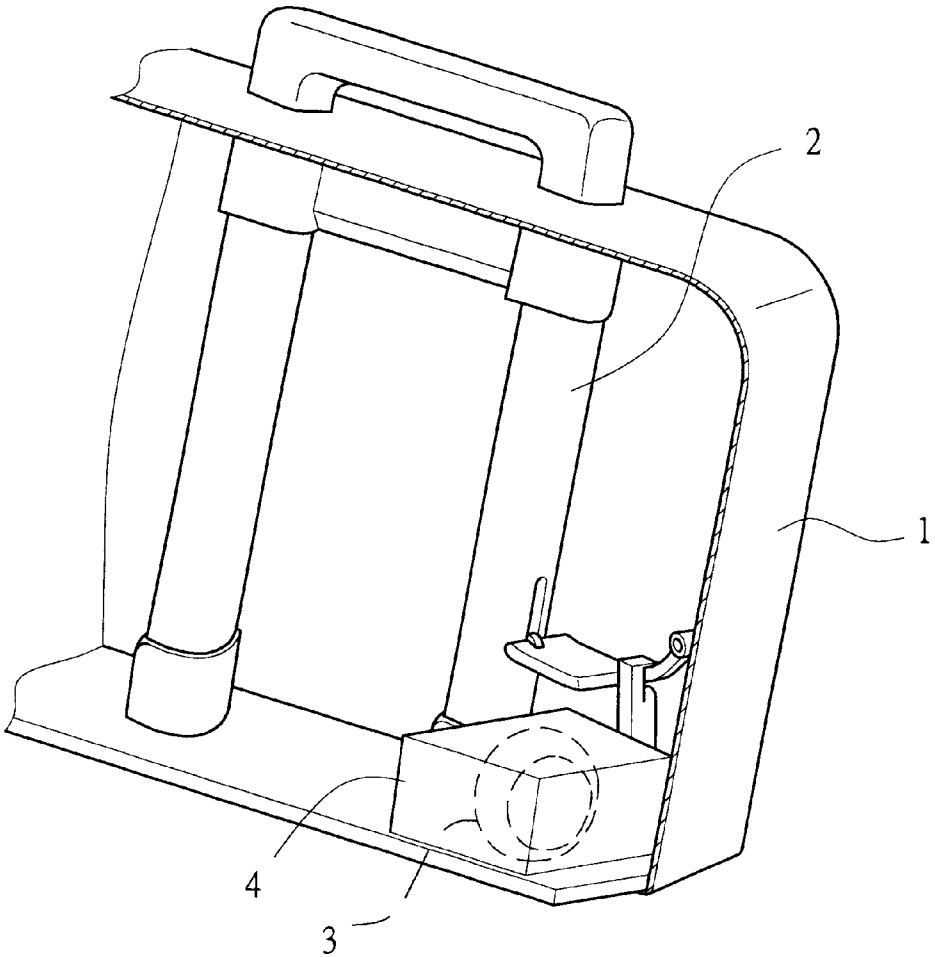
FIG. 1 is an illustration of the present invention being disposed inside the luggage case.
Figure 2:
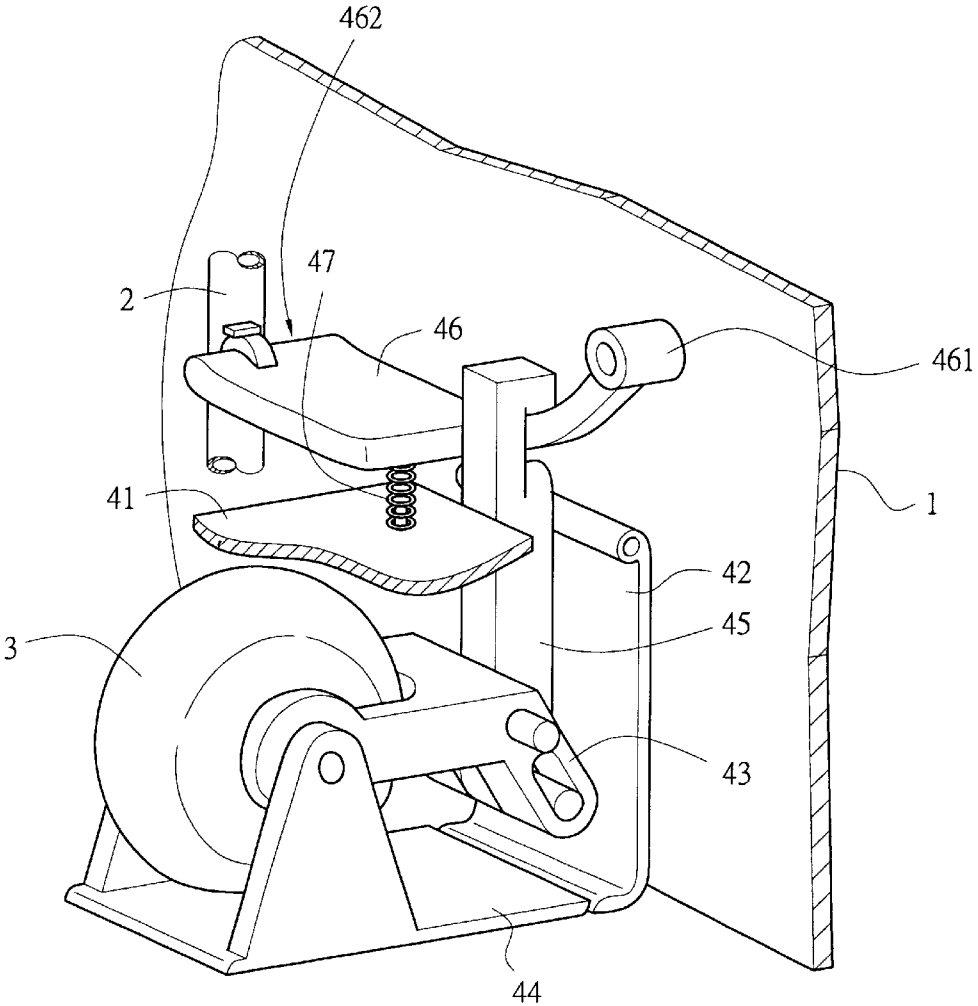
FIG. 2 is a perspective view of the present invention organized in the luggage.
Figure 3:
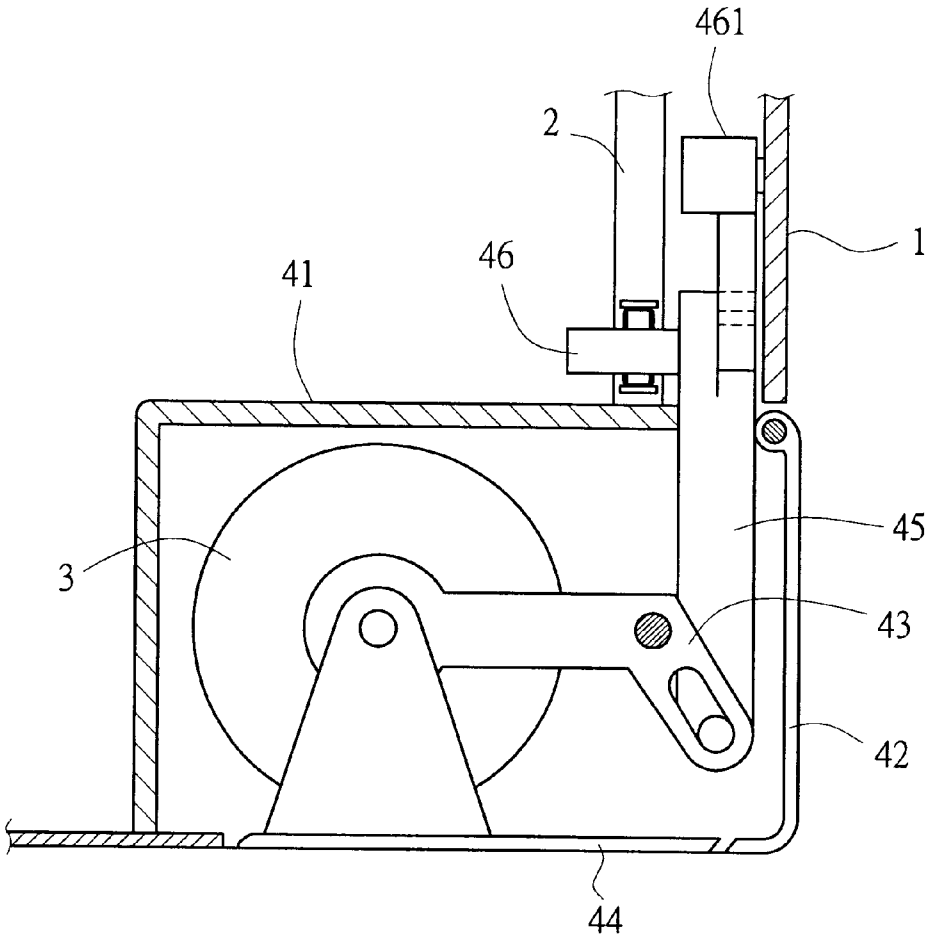
FIG. 3 is a cross-sectional view showing the present invention being hidden inside the luggage case.

First of all, referring to FIG. 1, FIG. 2, and FIG. 3, the present invention includes a luggage case 1, a retractable handle 2 and at least two rollers 3 at the bottom of the luggage case 1. The invention features on that the roller 3 is arranged inside a retractile mechanism 4 having a housing 41, a lateral covering plate 42, a bottom covering plate 44, a roller support 43, a movable vertical stick 45, a swing panel 46 and a spring 47. The lateral covering plate 42 is arranged at one side of the housing 41 and the bottom covering plate 44 is coaxial to the roller 3—each plate formed part of the lateral side and the bottom side of the luggage case 1 respectively. The roller 3 is pivoted at one end of the roller support 43 while the movable vertical stick 45 is on the other end of the roller support 43 pivotally. The top of the movable vertical stick 45 is hooked with the swing panel 46. One end 461 of the swing panel 46 is pivoted on the wall of the luggage case 1 while the other end 462 is connected with the retractable handle 2. The spring 47 is disposed between the swing panel 46 and the housing 41.

Figure 4:
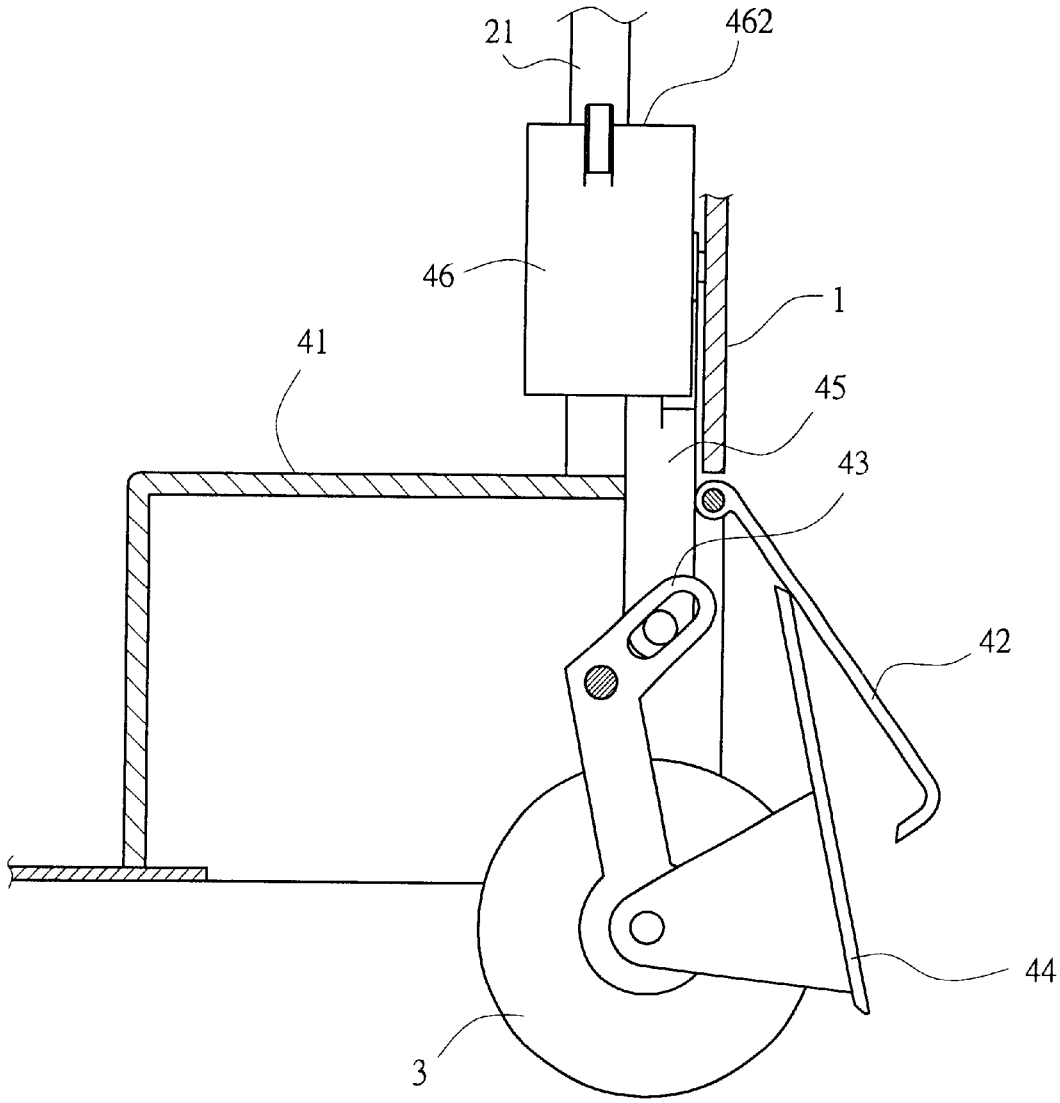
FIG. 4 is a cross-sectional view showing the present invention protruding outside the luggage case.

In accordance with the structure mentioned above, with reference of FIG. 4, once the retractable handle 2 is pulled up, it tows the swing panel 46 which drags up the movable vertical stick 45 and the roller support 43 is swung out by the movement of the movable vertical stick 45. Simultaneously, the bottom covering plate 44 also swings out, and the back of the bottom covering plate 44 pushes the lateral covering plate 42. At this time, the roller 3 on the bottom of roller support 43 extends to the outside of luggage case 1 bottom as shown on FIG. 4. Then the luggage case could be hauled.

While pressing the retractable handle 2, refer to FIG. 3, it drags the swing panel 46 to press the movable vertical stick 45 and make the roller support 43 retract inside so as to fold the roller 3 into the housing 41. And the bottom covering plate 44 and the lateral covering plate 42 fold at the bottom and side of the luggage case 1 respectively to make luggage case 1 looks smooth without any beetle at its outlook. Moreover, no beetles outside the surface of case make moving more easily without catch other luggage.

Additionally, the luggage case could be a travel case, travel bag, boarding case, and computer bag, etc. If the luggage case 1 is made of soft material such as cloth, the retractile mechanism 4 is fixed on a plate made of hard material first and then is attached firmly on the soft luggage case 1 by rivets or sewing.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claim.

What is claimed is:

1. A roller device of luggage case comprising rollers disposed on a bottom of a luggage case, said luggage case having a retractable handle and at least two of said rollers on the bottom thereof;

wherein the improvement is characterized by:

each of said rollers is arranged inside a retractile mechanism comprising a housing, a lateral covering plate disposed at lateral side of said housing, forming part of the lateral side of said luggage case, a bottom covering plate coaxial to said roller, forming part of the bottom side of said luggage case, a roller support pivoted each of said rollers at one end thereof a movable vertical stick pivoted on the other end of said roller support, a swing panel hooked on the top of said movable vertical stick with one end thereof pivoted on the wall of said luggage case while the other end thereof is connected with said retractable handle, a spring set between said swing panel and said housing;

wherein while pulling up said retractable handle, each of said rollers extends to the outside of the bottom of said luggage case and said lateral covering plate as well as said bottom covering plate swing outward.

* * * * *